United States Patent [19]

Rivera

[11] Patent Number: 4,595,101

[45] Date of Patent: Jun. 17, 1986

[54] PORTABLE FOOD CARRYING DEVICE

[76] Inventor: Henry C. Rivera, 700 Pueblo Rd., Milford, Mich. 48042

[21] Appl. No.: 627,189

[22] Filed: Jul. 2, 1984

[51] Int. Cl.[4] ..... B65D 81/38

[52] U.S. Cl. ..... 206/545; 126/339; 206/549; 211/128; 383/26; 383/103; 383/110

[58] Field of Search ..... 206/545, 548, 549, 551; 150/113, 116, 107; 220/22; 99/385; 126/337 R, 339; 211/13, 134, 128, 181; 383/100, 103, 110, 901, 25, 26

[56] References Cited

U.S. PATENT DOCUMENTS

| | | | |
|---|---|---|---|
| 1,564,101 | 12/1925 | Nakamura | 383/25 X |
| 2,448,319 | 8/1948 | Maranville | 211/134 |
| 2,598,995 | 6/1952 | Graff | 206/545 X |
| 2,661,785 | 12/1953 | Daust | 206/545 X |
| 2,765,833 | 10/1956 | Kwon | 150/107 |
| 2,960,136 | 11/1960 | Zaff | 383/110 |
| 3,353,886 | 11/1967 | Tompkins | 206/545 |
| 3,428,103 | 2/1969 | Walsh | 383/110 X |
| 4,211,267 | 7/1980 | Skovgaard | 383/110 X |

FOREIGN PATENT DOCUMENTS

| | | | |
|---|---|---|---|
| 2520881 | 11/1976 | Fed. Rep. of Germany | 206/545 |

*Primary Examiner*—Allan N. Shoap
*Assistant Examiner*—Bryon Gehman
*Attorney, Agent, or Firm*—Markell Seitzman

[57] ABSTRACT

A portable food carrying device comprising means for supporting at least one substantially flat food item in a predetermined orientation, and means for enveloping and for insulating the supporting means comprising an insulated, flexible container including an open end adapted to receive the supporting means, where the supporting means cooperates with the flexible container to provide a skeletal support therefor.

4 Claims, 4 Drawing Figures

FIG.3
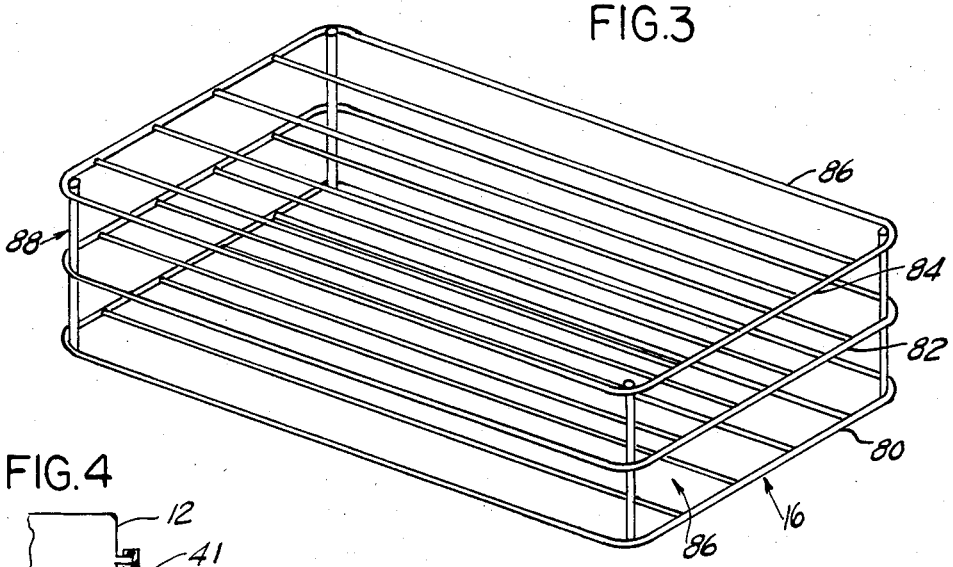
FIG.4
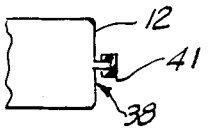
FIG.2
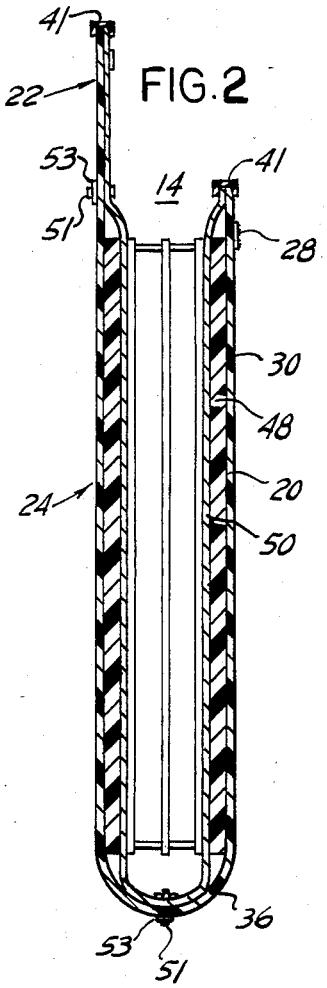
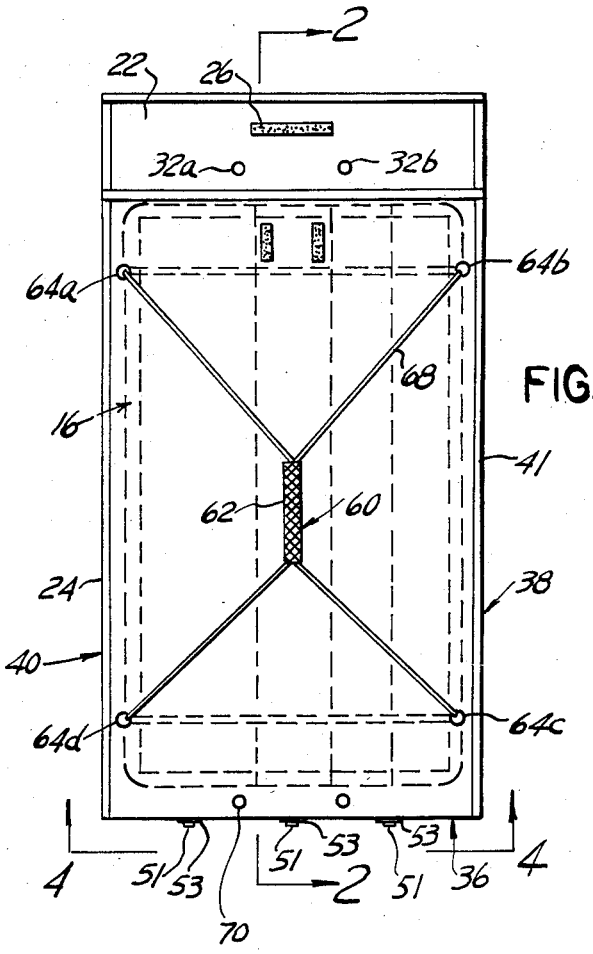
FIG.1

PORTABLE FOOD CARRYING DEVICE

BACKGROUND OF THE INVENTION

The invention relates to portable insulated food carriers in general and, in particular, to a portable food carrier for pizza and other take-out foods.

Illustrative of the prior art are U.S. Pat. Nos. 4,170,302 and 4,344,534 and 4,058,214 which illustrate rigid containers having insulated walls and a separate lid into which the baked pizza is placed and thereafter transported to the customer. The pizzas may be packaged, as is customary, in paper bags, boxes or other noninsulated containers prior to insertion within the insulated carrier.

The present invention comprises a low profile, flexible, preferably insulated vinyl container or bag which resists cracking, denting or tearing, is compact, requires little space and which can be easily cleaned inside and out. The invention further comprises a rack which is inserted within the vinyl bag permitting food items such as pizzas, preferably in bags or boxes, to be oriented in a preferred manner therein.

In one embodiment of the invention these food items are stacked vertically on cooperating shelves of the rack. The invention further includes a self-leveling handle which stabilizes the container or bag for easy carrying.

The present invention eliminates those deficiencies in the prior art. Rigid containers such as those which utilize styrofoam often develop cracks and breaks making these containers hard to clean, of short useful life and display a tendency for retaining odors. The present invention further eliminates the need for exterior sources of heat such as electricity or a flammable gaseous heat source.

Accordingly the invention comprises a portable food carrying device comprising means for supporting at least one food item placed in a substantially flat food container such as paper or a box in a predetermined orientation and means for enveloping and for insulating the supporting means comprising an insulated, flexible container adapted to receive the supporting means wherein the supporting means cooperates with the flexible container to provide a skeletal support therefor.

BRIEF DESCRIPTION OF THE DRAWINGS

In the drawings:

FIG. 1 illustrates a top plan view of the present invention.

FIG. 2 illustrates a cross-sectional view of the present invention.

FIG. 3 illustrates a typical rack which is used within the present invention.

FIG. 4 illustrates a reinforcement webbing used.

DETAILED DESCRIPTION OF THE DRAWINGS

With reference to the drawings, there is illustrated an insulated, flexible, portable food carrying device, container or carrier 10 which comprises a flexible bag 12. The bag 12 preferably includes an open end 14 into which a rack 16 may be inserted. It is not a requirement of the invention that the end 14 be open, such an opening may be made in any of the surfaces of the bag 12. The rack 16 provides the skeletal support structure of the bag 12 and may be removed therefrom for easy cleaning of the interior walls of the bag 12. The bag 12 includes an outer layer 20 which preferably is a vinyl having a non-woven backing. The vinyl is preferably a low porosity material. This outer layer 20 defines a flap 22 which extends from the main body 24 of the bag 12 and permits the closing of the open end 14. The flap 22 may include means for closing, such as a Velcro strip 26 which engages a cooperating Velcro strip 28 secured to an upper side 30 of the bag 12. The flap 22 may further include a plurality of openings or air vents 32 which may be formed by brass grommets and washers to provide ventilation. The bag 12 is preferably constructed of a single outer layer 20 folded proximate its middle 36 and sewn together at its edges 38 and 40. A webbing, such as a nylon webbing 41, may be utilized to secure the sewn edges 38 and 40 providing additional tensile strength to the sewn edges 38 and 40. FIG. 4 more clearly illustrates the relationship of one side 40 and its corresponding webbing 41.

The bag 12 further includes a middle insulative layer 48 of preferably a medium density polyurethane foam which serves to insulate the food to be carried and further provides a cushion for protecting the items within the bag 12. The middle layer 48 is bonded to the interior walls of the vinyl outer layer 30. An inner layer 50, preferably constructed of a heat reflective fabric laminated aluminum foil, is bonded to the middle layer 48 and sewn proximate the open end 14 to the vinyl outer layer 30 to fully protect and cover the middle layer 48. The webbing 41 further reinforces the bond between the middle layer 48 to the outer layer 30. Further, brass grommets 51 and/or washers 53 additionally secure the various layers together.

The container 10 further includes self-leveling handle means 60 comprising an elongated handle 62 situated approximately equidistant from four openings 64A–D in the top of the bag 12. A pair of ropes 68 extend from each end of the handle 62 to a pair of oppositely situated openings 64 and further extend under the underside of the top side of the bag 12 forming a continuous filament. The openings 64 may be formed by grommets and washers. Additional air vents 70 may be formed proximate the middle 36 of the bag 12. In this manner excess steam may escape through air vents 32 and 70.

Each rack or frame 16 is preferably constructed of a 3/16" diameter steel wire that is electrostatically coated. The frame 16 defines in one embodiment a wire cage defining a lower, a middle and an upper platform 80, 82 and 84 respectively, forming a plurality of compartments. These platforms 80–84 are spaced one to the other and define open ends 86 and 88. In the embodiment illustrated in the accompanying figures, the frame 16 is inserted into the open end 14 of the bag 12 and provides two shelves into which food items such as pizzas are inserted, the first pizza resting upon platform 80 and the second pizza resting upon platform 82. The outermost platforms, i.e., platforms 80 and 84, provide the skeletal structure for the container 10 and further permit a plurality of containers 10 to be stacked one to the other without risk of damage to the food within each respective container 10 and space each food item apart from the container 10.

It should be apparent from the above description the frame 16 is not limited to three vertically situated platforms thus permitting more than two pizzas to be stacked vertically. In addition the frame 16 may be constructed utilizing only two platforms such as 80 and 82 for transporting single pizzas or may be of elongated construction such that a plurality of pizzas may be laid adjacent to one another, this defining a relatively flat streamlined container 10 .

Many changes and modifications in the above-described embodiment of the invention can, of course, be carried out without departing from the scope thereof. Accordingly, that scope is intended to be limited only by the scope of the appended claims.

What is claimed is:

1. A portable food carrying device comprising:

a low profile, insulated, flexible container comprising:

a planar top, a planar bottom, and a plurality of planar sides connecting said top and said bottom, one of said sides being open;

said top side and said bottom side of said device having a pair of short edges and a pair of long edges in a substantially rectangular shape and being the largest sides of said device;

a low profile rack received into the open side for providing a skeletal support for said flexible container and for supporting food apart from the interior of said container;

said rack comprising:

a frame including a bottom element forming substantially rectangular first member, said first member including a plurality of spaced parallel wires linking two parallel opposing sides of said bottom for supporting said food;

a top element positioned above said bottom element forming a substantially rectangular second member including a plurality of spaced, parallel situated wires linking two parallel opposing sides thereof;

a middle element positioned between said top and said bottom elements comprising a substantially rectangular third member including a plurality of spaced wires linking opposing parallel sides thereof;

wherein said top, middle and bottom elements comprise rounded corners;

a plurality of vertical support members joining opposing corners of said bottom element to said middle element to said top element in a spaced apart orientation, said spacing sufficient to permit receipt of said food therein, through said open side after said rack has been inserted within said container;

self-leveling carrying means for carrying said container and said rack therein; wherein the top surface of said container includes two pairs of spaced openings, one pair being disposed along each long edge, the distance between the openings along the long edge in each pair being equal to or greater than the distance between the openings along the short edge, and wherein said self-leveling carrying means comprises an elongated handle situated approximately equidistant from particular ones of said openings, a plurality of ropes extending from each end of said handle through an oppositely situated pair of openings, and running underneath the top surface of said device, wherein said ropes are joined one to the other forming a continuous filament;

wherein said top, bottom and said side include:

an inner layer of flexible heat reflective material;

a layer of flexible insulative material applied over said inner layer, and an outer layer of relatively impermeable flexible material applied to said insulative material.

2. A portable food carrying device comprising:

a low profile, insulated, flexible container comprising;

a planar top, a planar bottom, and a plurality of planar sides connecting said top and said bottom, one of said sides being open;

said top side and said bottom side of said device having a pair of short edges and a pair of long edges in a substantially rectangular shape and being the largest sides of said device;

a low profile rack received into the open side for providing a skeletal support for said flexible container and for supporting food apart from the interior of said container;

said rack comprising:

a frame including a bottom element forming a substantially rectangular first member, said first member including a plurality of spaced parallel wires linking two parallel opposing sides of said bottom for supporting said food;

a top element positioned above said bottom element forming a substantially rectangular second member including a plurality of spaced, parallel situated wires linking two parallel opposing sides thereof;

wherein said top and bottom elements comprise corners;

a plurality of vertical support members joining opposite corners of said bottom element to said top element in a spaced apart orientation, said spacing sufficient to permit receipt of said food therein, through said open side after said rack has been inserted within said container;

self-leveling carrying means for carrying said container and said rack therein;

wherein the top surface of said container includes two pairs of spaced openings, one pair being disposed along each long edge, the distance between the openings along the long edge in each pair being equal to or greater than the distance between the openings along the short edge, and wherein said self-leveling carrying means comprises all elongated handle situated approximately equidistant from particular ones of said openings, a plurality of ropes extending from each end of said handle through an oppositely situated pair of openings, and running underneath the top surface of said device, wherein said ropes are joined one to the other forming a continuous filament;

wherein said top, bottom and said sides include;

an inner layer of flexible heat reflective material, a layer of flexible insulative material applied over said inner layer, and an outer layer of relatively impermeable flexible material applied to said insulative material.

3. The device as recited in claim 2 wherein said rack further comprises:

a middle element spaced between said top and said bottom elements, said spacing sufficient to permit receipt of food therein, comprising a substantially rectangular third member including a plurality of spaced wires linking opposing parallel sides thereof; and wherein said vertical support members join said middle element at corners thereof to said bottom and said top elements in a spaced apart orientation.

4. The device as defined in claim 3 wherein said corners of said top, middle and bottom elements are rounded.

* * * * *